United States Patent [19]

Swales, deceased et al.

[11] 4,002,120

[45] Jan. 11, 1977

[54] MISSILE STAGE COUPLER

[75] Inventors: Frank Swales, deceased, late of Saratoga, Calif.; by Doris Swales, heir, Sunnyvale, Calif.; by Sally M. Swales, heir, Mountain View, Calif.; by Pamela J. Lettis, heir, Cupertino, Calif.

[73] Assignee: The United States of America as represented by the Secretary of the Navy, Washington, D.C.

[22] Filed: July 31, 1975

[21] Appl. No.: 600,662

[52] U.S. Cl. ..... 102/49.5; 85/DIG. 1

[51] Int. Cl.[2] ..... F42B 15/10

[58] Field of Search ..... 102/49.5; 85/DIG. 1, 85/1 R, 33; 29/200 D; 89/1 B

[56] References Cited

UNITED STATES PATENTS

| | | | |
|---|---|---|---|
| 3,114,962 | 12/1963 | Brown | 85/DIG. 1 |
| 3,115,836 | 12/1963 | Brashears | 102/49.5 |
| 3,262,351 | 7/1966 | Webb | 85/DIG. 1 |
| 3,597,919 | 8/1971 | Lilly | 102/49.5 |
| 3,813,984 | 6/1974 | Selinder | 85/DIG. 1 |

*Primary Examiner*—Samuel Feinberg
*Attorney, Agent, or Firm*—R. S. Sciascia; Charles D. B. Curry

[57] ABSTRACT

An apparatus for coupling the stages of a missile or other multistage moving object which is adapted to release the stages at a desired time. A separation bolt connects for and aft stages prior to a desired signal. The bolt is held at its lower portion in an assembly capable of thrusting it entirely into the other stage upon the signal. A bolt catcher captures the bolt in the other stage.

6 Claims, 2 Drawing Figures

FIG_1
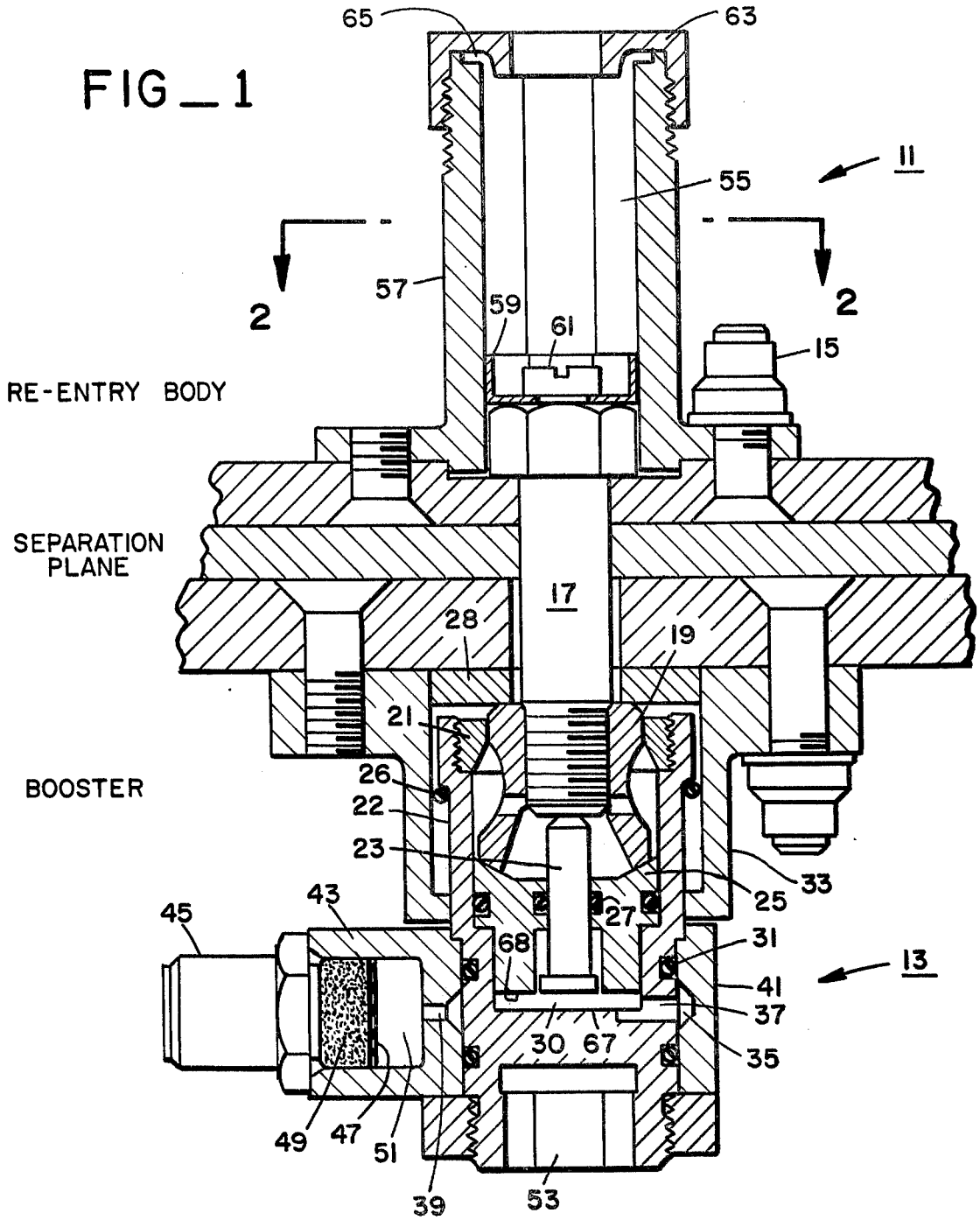
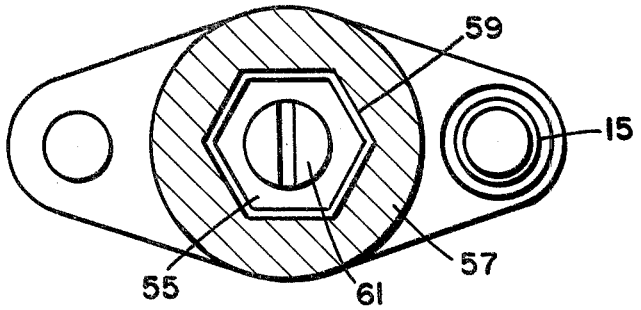
FIG_2

MISSILE STAGE COUPLER

BACKGROUND OF THE INVENTION

1. Field of the Invention

The present invention relates to missile stage coupling systems. More particularly, it pertains to means for fastening together and attaining the in-flight separation of any two stages of a missile or space flight device while minimizing the possibility of tipoff.

2. Description of the Prior Art.

Various approaches have been employed in the area of missile stage coupling and separation. Ball lock joints and latches frequently have been utilized to join stages. The problems related to the separation process have been treated by a wide variety of approaches. Often separation systems have focussed upon the desire to minimize the problem of tipoff. Tipoff occurs when a clean and immediate separation is not achieved between the stages and can result in the lower stage, for example a booster, imparting an undesired reorientation of the trajectory to the on-flying stages.

Prior attempts to minimize tipoff have included the use of a frangible disc, a clamping ring, explosive cord, shaped explosive charge, and imparting relative movement between the stages. They have generally relied upon the use of explosives placed at or near the junction of the stages. The very operation of such devices introduces perturbations into the trajectory of the on-flying stage.

The present invention provides both for the secure coupling and smooth separation of missile stages by providing a separation bolt at the junction of the stages of a missile or other moving body. The bolt is propelled from a position securing the stages wholly into one of them upon a predetermined signal. A clean break is thus made at the desired instant without reliance on the occurrence of an explosion at the junction of the stages.

SUMMARY OF THE INVENTION

The present invention basically includes a separation bolt whose head portion is contained in a bolt catcher of novel design and whose lower portion is retained in a combination retainer and ejector. The bolt catches is located in one of two adjoining stages of a missile or other moving body and the retainer and ejector is contained in the other. The retainer applies sufficient force upon the lower portion of the bolt to retain the bolt and thus hold the stages together during the cooperative flight stage. Upon completion of the cooperative flight stage, the ejector is activated by a signal to release the bolt and a coaxial force is applied to the bolt in the direction of the bolt head. The bolt is projected wholly into the stage containing the bolt head where it is captured in the bolt catcher after forcefully impacting upon the cover of the bolt catcher.

STATEMENT OF THE OBJECTS OF THE INVENTION

An object of this invention is to provide a means of securing multiple stages of a missile or other vehicle which will allow separation of the stages at the desired time.

A further object of this invention is to provide a means of disengaging and repelling the stages from each other at the desired time.

Another object of this invention is to provide a system that achieves the above object while minimizing the possibility of tipoff or other flight perturbation.

Yet another object of this invention is to provide a missile stage coupling and release mechanism that does not position an explosive charge at the junction of the stages.

Still another object of this invention is to provide a missile stage coupling and release mechanism that may be adapted to a wide range of missile stage design and cause little alteration, if any, of stage designs by its use.

Other objects, advantages and novel features of the invention will become apparent from the following detailed description of the invention when considered in conjunction with the accompanying drawings wherein:

BRIEF DESCRIPTION OF THE DRAWINGS

FIG. 1 is a sectional view of the invention.

FIG. 2 is a top sectional view of the bolt catcher according to the invention taken along line 2—2 of FIG. 1.

DESCRIPTION OF THE PREFERRED EMBODIMENT

Referring now to the drawings, there is shown in FIG. 1 the missile stage connector of the invention. The assembly illustrated is mounted for use with a re-entry body and its booster stage. The bolt catcher 11 is associated with the re-entry stage and the separation nut assembly 13 with the booster stage.

Standard attachment means 15, such as bolts, join the flanged portions of bolt catcher 11 to the re-entry body and separation nut assembly 13 to the booster. Although such a relative positioning of these major subassemblies is not necessary in the successful practice of the invention, the relative sizes of the particular subassemblies illustrated dictates such location for reasons of flight weight economy.

Separation bolt 17 intersects both stages. The bolt is threaded at its lower portion and has a head of regular cross section. Its lower portion is threadedly engaged into segmented retainer 19.

The retainer is of a flared construction, the upper portion of which is interiorly threaded. An abutting ring 21 in threaded engagement with nut inner housing 22 urges the top portions of the segments into threaded engagement with the bolt. An ejector piston 23 is coaxially aligned with the bolt. The piston is located within a chamber surrounded by compression platform 25. O ring 27 maintains the desired vertical positioning of the piston within its chamber and seals a portion of chamber 30.

Compression platform 25 is contained within nut inner housing 22 which extends to the top of and encloses bolt retainer 19. O ring 31 is provided to fix the relationship between the nut inner housing and the compression platform and further seal chamber 30. Finally, separation nut body 33 encloses the entire separation nut assembly and is joined to the booster stage by attachment means 15.

A channel 35 encircles the lower portion of the separation nut assembly. Drilled counterbore 37 provides a hollow passageway between tube 39 and the chamber portion surrounding ejector piston 23. Sheath 41 commutes with hollowed nut 43 to enclose the hollow channel. Hollowed nut 43, into which pyro squib 45 is fitted in threaded engagement, commutes interiorly with tube 39. A diaphragm 47, located within the chamber of hollowed nut 43, retains explosive charge 49 and partitions a compression chamber 51. Pyro squib 45 reacts to an electrical signal to ignite the explosive charge, which may be any of a number of standard charges, such as black power, etc.

A depression 53 of regular cross section is provided at the bottom of the separation nut assembly for insertion of an adjustment tool. The depression allows one to apply torque to the otherwise inaccessible separation bolt 17. The fact that the inner surface of separation nut body 33 and the outer surface of nut inner housing 22 are in neither locked nor threaded radial relationship provides that all torque thus applied will be utilized to tighten the separation bolt.

With reference to FIGS. 1 and 2, it is seen that bolt catcher 11 generally comprises a chamber 55 of cross section compatible to the cross section of the head of separation bolt 17 formed by bolt catcher frame 57. A guide 59 is fastened to the top of the separation bolt by screw 61 to stabilize the path of the bolt during ejection from the separation nut assembly. The guide is of such dimensions and design as to maintain contact with the interior of bolt catcher frame 57 at its periphery. An upturned edge is located at the periphery of the guide to further stabilize the path of the bolt.

A cover 63, having a hole to accommodate the screw, is threadedly engaged at the top of the bolt catcher frame. An aperture 65 exists at the interior rim of the junction of the frame and the top to accommodate the upturned edge of the guide upon ejection of the separation bolt.

In operation, the pyro squib 45 of the missile stage connection assembly is connected to an electrical signal output. Upon receipt of such a signal, the pyro squib ignites the explosive charge 49. The explosion shatters the diaphragm 47, causing the expansion of gases through tube 39 into channel 35. Drilled counter bore 37 allows the transfer of the gases and attendant pressure into the chamber 30 which exists surrounding ejector piston 23 and the interfaces 67 and 68 within the separation nut assembly 13.

The increased pressure in the chamber bounded by the ejector piston held in threaded engagement to bolt retainer 13 causes the downward movement of nut inner housing 22 relative to separation nut body 33 due to the fact that their corresponding surfaces are smooth and unthreaded. The interface between rectangular ring 21 and bolt retainer 19 is smooth. A relative downward movement of ring 21 due to its threaded engagement with nut inner housing 22 relocates the ring to a more constricted geometry of the bolt retainer, lessening the inward, or retaining, force on the lower portion of separation bolt 17.

The release of the retaining force on bolt 17, coupled with the buildup of pressure in chamber 30 allows the piston to move upward, ejecting separation bolt 17 from the separation nut assembly 13 with great force. The bolt travels upward within bolt catcher chamber 55 at a high velocity, exerting considerable separation force upon cover 63 and affecting the removal of all connection between the stages at the location of the particular assembly. In practice, virtually no time lag exists between the transmission of the signal to the pyro squib and the release of the separation bolt. Thus a complete, clean and instantaneous separation of the stages is achieved.

The inventor has included a pyro squib and the particular separation nut assembly for purposes of complete illustration of an embodiment of the invention. As will be obvious to those skilled in the art, other devices, such as spring-loaded mechanisms or hot or cold gas ejection systems, may be adapted to perform the separation bolt ejection function.

It has also been found that a symmetrical array of a plurality of the above described apparatus may be adapted to perform the stage coupling and separation functions. Practice indicates that three or four such bolts may secure and effectively separate a re-entry stage from its booster. In such an array simultaneous separation of all points of attachment between the stages is easily achieved by connecting each pyro squib to the same electrical signal source.

In view of the foregoing, it can be seen that a missile stage coupling system has been achieved which both secures and separates the stages of a missile while minimizing the problem of tipoff.

What is claimed is:

1. A separation system comprising:

a. a first missile stage;

b. a second missile stage;

c. means for joining and separating said first and second missile stages;

d. said means including a bolt, at least one catcher for securing one portion of said bolt to said first missile stage, at least one securing means for joining another portion of said bolt to said second missile stage, and ejection means for propelling said bolt from said second missile stage into contact with said first missile stage;

e. said bolt having a head portion, a bottom portion and a shaft therebetween, the cross-section of said shaft being of lesser dimension than that of the head portion;

f. each catcher being a bolt catcher having a top portion, a bottom portion and a body therebetween, said bottom portion having a hole therein, said hole being of cross-section at least equal to the cross-section of said shaft and less than at least one cross-section dimension of said bolt head portion;

g. said bolt further having a flat guide located at the top of said bolt head portion having a size and shape identical to the interior cross-section of the body of said bolt catcher and an upturned edge located at its periphery to further stabilize the upward trajectory of said bolt upon ejection from the second stage;

h. said bolt catcher further having a cover located at said top portion said cover having a groove located at the interior junction of said cover and the body of said bolt catcher to accommodate the upturned edge of said guide upon ejection of said bolt from the second stage;

i. the head of said bolt contained within said bolt catcher, the shaft passing through the hole in said bolt catcher and the bottom portion of said bolt joined to said securing means to join said missile stages together;

said ejection means comprising at least one ejector, each of which is simultaneously activated by an electrical signal; whereby k. upon ejection from said second missile stage the energy of said propelling bolt is transferred to said first missile stage through the body of said bolt catcher, providing a separation thrust to said first missile stage to separate it from said second missile stage.

2. An apparatus for coupling and separating a first object and a second object with comprises:

a. a bolt having a head portion, a bottom portion and a shaft therebetween the cross-section of said shaft being of lesser dimension than that of the head portion;

b. a flat guide located at the top of the head portion of the bolt which has a shape and size identical to the cross-section of said head portion and an upturned edge located at its periphery to stabilize an upward trajectory of the bolt within a cylindrical shaft;

c. a bolt catcher located in the first object and having a top portion and a bottom portion and a body therebetween, said bottom portion having a hole therein said hole being of cross-section at least equal to the cross-section of said shaft and less than at least one cross-section dimension of the head portion and said body being interiorly hollowed to conform in interior cross-section to the cross-section of the head portion of said bolt;

d. means for securing the bottom portion of said bolt located in the second object;

e. the head of said bolt contained within the bolt catcher, the shaft passing through the hole in the bolt catcher and the bottom portion joined to said securing means whereby said first object and said second object are thereby joined together; and f. an ejector to propel the bottom portion of th bolt from the second object and into the first object into contact with said first object; whereby g. the energy of said propelled bolt is transferred to said first object thereby causing separation of said first and second objects.

3. A bolt catcher as described in claim 2 which further comprises a cover located at the top portion of the bolt catcher to contain said bolt within said bolt catcher after ejection of the lower portion of said bolt into said first object said cover having a groove located at the interior junction of said cover and the elongated portion of the bolt catcher to accommodate the upturned edge of said guide upon ejection of the bolt from the second object.

4. Apparatus as described in claim 3 wherein said apparatus additionally comprises a retention screw seated in the middle of said flat guide to maintain said flat guide in fixed relationship to the head of said bolt.

5. A bolt catcher as described in claim 4 wherein said cover has a hole the center of which is coincident with the axis of said bolt, the cross-section of said hole being at least as great as the cross-section of said retention screw.

6. An ejector as described in claim 5 which further comprises an activator sensitive to a predetermined electrical signal whereby said ejector is activated to propel the bottom portion of the bolt from the second object and into the first object upon the receipt by the activator of said signal.

* * * * *